United States Patent [19]

Wilde

[11] Patent Number: 4,801,018

[45] Date of Patent: Jan. 31, 1989

[54] CORNER PROTECTORS

[76] Inventor: Melvyn Wilde, Unit 1A, Empress Industrial Estate, Anderton St., Higher Ince Wigan, Great Britain

[21] Appl. No.: 78,116

[22] Filed: Jul. 27, 1987

[30] Foreign Application Priority Data

Jul. 29, 1986 [GB] United Kingdom ..... 8618500

[51] Int. Cl.[4] ..... B65D 59/00

[52] U.S. Cl. ..... 206/586; 206/453; 248/345.1

[58] Field of Search ..... 206/586, 453; 248/345.1

[56] References Cited

U.S. PATENT DOCUMENTS

| | | | |
|---|---|---|---|
| 1,676,741 | 7/1928 | Moskowitz . | |
| 3,047,142 | 7/1962 | Heffley | 206/453 |
| 3,049,260 | 8/1962 | Stone | 229/DIG. 1 |
| 3,144,236 | 8/1964 | Clamin | 248/345.1 |
| 3,184,135 | 5/1965 | Johnson | 206/586 |
| 4,063,702 | 12/1977 | Wilde | 248/345.1 |
| 4,238,031 | 12/1980 | Skaggs | 206/586 |
| 4,385,698 | 5/1983 | Goquen | 206/453 |

FOREIGN PATENT DOCUMENTS

| | | | |
|---|---|---|---|
| 2827846 | 9/1979 | Fed. Rep. of Germany . | |
| 2951402 | 6/1981 | Fed. Rep. of Germany | 206/586 |
| 1458872 | 12/1976 | United Kingdom . | |

*Primary Examiner*—Henry E. Raduazo

*Attorney, Agent, or Firm*—William R. Hinds

[57] ABSTRACT

There is described a protector for the corner of an article, the article at the corner having two substantially plane, usually parallel, faces and adjacent edge faces 22, 23, the protector having two spaced members 13, 14 to slide over respective ones of said faces and side wall members connecting the two spaced members for overlying the edge faces, the members defining a mouth to allow the protector to be applied to the corner, the side wall members having at least a portion 18 intermediate the spaced members adapted to resist movement of the spaced members towards or away from each other.

Each side wall has confronting flanges 16, 19 connected by web 18 and parallel slots 9 are formed in the flanges, an L shaped web 30 connects webs 18 and provides central protection for the article corner. Corner junction 40 may be strengthened by a bead.

19 Claims, 1 Drawing Sheet

CORNER PROTECTORS

This invention relates to corner protectors and in particular to protectors for the corners of articles having, at their corners, two substantially plane faces and two adjacent edge faces.

Examples of such protectors are disclosed in U.S. Pat. No. 4,063,702 and British Specification No. 1458872 which show protectors having top and bottom parts which are connected by resilient means so that they can move apart to accommodate various corner thicknesses. Other corner protectors are shown in U.S. Pat. Nos. 3,047,142; 3,049,260; 3,144,236.

According to this invention there is provided a protector for the corner of an article, the article at the corner having two substantially plane faces and two adjacent edge faces, the protector having two spaced members to slide over respective ones of the plane faces, the protector having side wall members connecting the two spaced members for overlying respective ones of the edge faces, the spaced members and side wall members defining a mouth to allow the protector to be applied to the corner, each side wall member comprising confronting flanges extending respectively from sides of the spaced members and a web connecting the flanges intermediate the ends of the flanges, the side members comprising a first slot extending between the webs, and a second slot in one of the flanges, the second slot extending along the flange.

The side wall members may be essentially planar.

The protector may be a single plastics moulding. There may be a third slot between the webs, the third slot being nearer the other spaced member than the one spaced member to provide a further web between the first and third slots.

The web may be central along the flanges. The further web may be L-shaped.

The further web may be centrally disposed between the spaced members.

There may be a further slot in the other of the flanges. The second slot may be parallel to the spaced members. The second slot may be nearer the web than the adjacent spaced member.

The invention may be performed in various ways and two specific embodiments with possible modifications will now be described by way of example with reference to the accompanying drawings in which.

Figure 1:
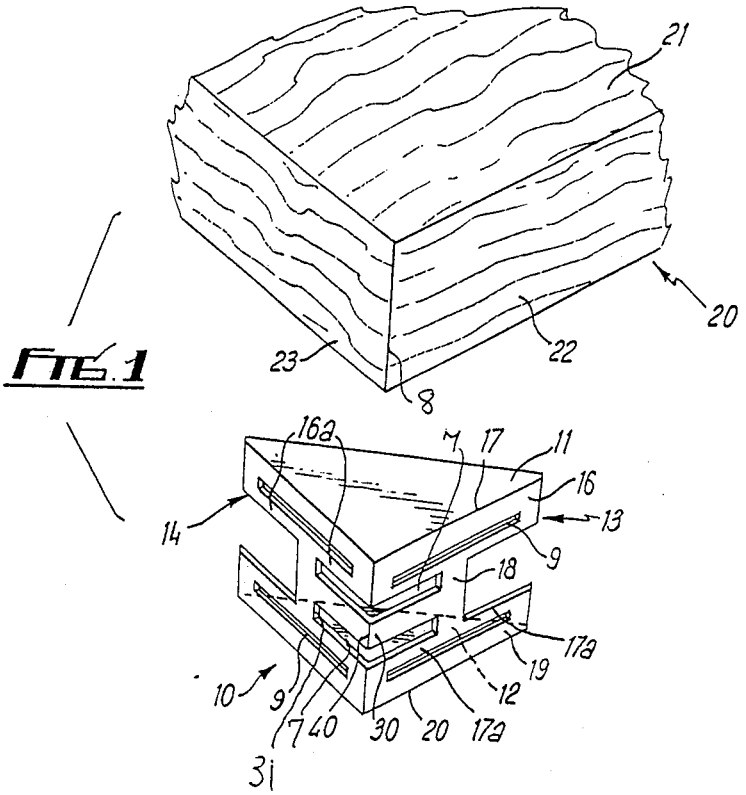
FIG. 1 is a perspective view of one arrangement.

A corner protector 10 is shown and a corner 20 of an article e.g. a book, magazine, table, panel or other item of building. The article has a plane top face 21 and a parallel lower plane face (not shown) connected by plane edge faces 22, 23 at right angles to the top and lower faces and each other, the faces 22, 23 meeting at edge or junction 8.

The protector, which may for example be mouled as a single moulding from low density polyethylene, has top and bottom parallel plane walls 11, 12 which forming spaced members are equiangular and whose shorter sides are at right angles and connected to the respective shorter side of the other wall 11 or 12 by side walls 13, 14 which are also essentially plane and meet at junction 40. The top face 21 and lower face need not be exactly parallel but could diverge or converge slightly in which case walls 11, 12 diverge correspondingly.

The side walls 13, 14 are integral at their inner edge 40 and essentially similar. Each side wall comprises a flange 16 depending from the side 17 of the top wall, a central web 18 connecting flange 16 to a confronting flange 19 upstanding from side 20 of the bottom wall 12. The flanges 16, 19 are similar and each has a rectangular slot 9 parallel to the sides 17, 20. The slots 9 extend equally on opposite sides of the web 18, and are centrally disposed along the length and depth of the respective flange 16, 19. The slot 9 could be nearer the web 18 than the adjacent wall 11 and the slot 9 in flange 19 could be nearer the web 18 than wall 12. The web 18 is at right angles to coplanar flanges 16, 19 and a flat L-section (as seen at right angles to wall 11) web member 30 spaced from flanges 16, 19 by slots 7 connects the central portions of the edges 31 of members 18 nearer the edge 40. The member 30 provides central protection to edge 8. One slot 7 may be omitted.

The members 18, 18 and 30 are essentially non-extensible and unaffected by forces on the walls 11, 12 at right angles to these walls and thus provide protection to the side walls 22, 23 when the protector 10 is fitted on corner 20 with walls 11, 12 respectively overlying, and normally engaging, the top and bottom faces of the article.

The portions **16*a* of flange 16 on either side of web 18 and on the side of the slot 9 nearer the bottom wall can flex slightly to permit slight separation or approach movement between walls 11, 12; and similarly for similar portions 17*a* of flange 19**.

The members 18, 18, 30 remain essentially in their respective plane or planes during use and resist undesirable movement of the walls 11, 12 towards or away from each other. This is to be contrasted with when top and bottom walls are only loosely connected and can be moved apart a substantial distance; in such a case there is a risk of the protector becoming dislodged by pulling on the upper or lower part of the protector, and also when the walls are moved apart there is no protection for the central region of the junction 8.

One or both of the edge faces 22, 23 could be convex outwards in which case the respective side member of the protector is shaped correspondingly.

Figure 2:
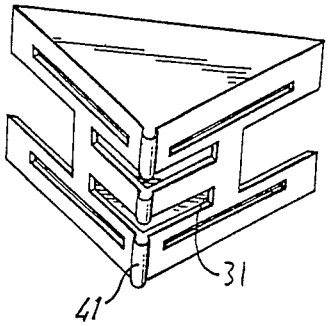
FIG. 2 is a perspective view of another arrangement.

In FIG. 2 the junction 40 is strengthened by an external part-circular bead or enlargement 41.

In applying the protector to the corner of the article the walls 11, 12 can be gripped near junction 40 to flex elements **16*a*, 17*a*** to slightly widen the mouth.

I claim:

1. A protector for the corner of an article, the article at the corner having two substantially plane faces and two adjacent edge faces, the protector having two spaced members to slide over respective ones of the plane faces, the protector having side wall members connecting the two spaced members for overlying respective ones of the edge faces, the spaced members and side wall members defining a mouth to allow the protector to be applied to the corner, each side wall member comprising confronting flanges extending respectively from sides of the spaced members, and a substantially non-extensible web connecting the flanges intermediate the ends of the flanges, a first slot extending between the webs of the side wall members, and a second slot in one of the flanges of each of the side wall members, the second slot extending along the respective flange.

2. A protector as claimed in claim 1, in which the side wall members are essentially planar.

3. A protector as claimed in claim 1, formed as a single plastics moulding.

4. A protector as claimed in claim 1, in which the web is central along the flanges.

5. A protector as claimed in claim 1, including a further slot between the webs, the further slot providing a further web between the first and further slots.

6. A protector as claimed in claim 5, in which the further web is L-shaped.

7. A protector as claimed in claim 5, in which the further web is centrally disposed between the spaced members.

8. A protector as claimed in claim 1, including another slot extending along the other of the flanges.

9. A protector as claimed in claim 1, in which the second slot is parallel to the spaced members.

10. A protector as claimed in claim 9, in which the second slot is nearer the web than the adjacent spaced member.

11. A protector for the corner of an article, the article at the corner having two substantially plane faces and two adjacent edge faces, the protector having two spaced members to engage over respective ones of the plane faces, the protector having side wall members connecting the two spaced members for overlying respective ones of the edge faces, the spaced members and the side wall members defining a mouth to allow the protector to be applied to the corner, each side wall member comprising (a) flanges extending respectively from a side of each spaced member towards the other spaced member, (b) a closed slot extending along at least one of the flanges, (c) a non-extensible web connecting the flanges inwards of an outer end thereof; and a further slot in the web of one side wall member and extending into the web of the other side wall member.

12. A protector as claimed in claim 11, including another slot in the web of said one side wall member and extending into the web of the other side wall member.

13. A protector as claimed in claim 12, in which the further slot and the another slot are parallel.

14. A protector for the corner of an article, the article at the corner having two substantially plane faces and two adjacent edge faces providing a corner edge, the protector having two spaced members to engage over respective ones of the plane faces, the protector having side wall members connecting the two spaced members for overlying respective ones of the edge faces, the spaced members and the side wall members defining a mouth to allow the protector to be applied to the corner, each side wall member comprising (a) confronting flanges extending respectively from sides of the spaced members, (b) a closed slot extending along at least one of the flanges, (c) a non-extensible web connecting the flanges inwardly of an outer end thereof; the webs of the side wall members being integral for overlying the corner edge; and a closed slot extending from one web into the other web.

15. A protector as claimed in claim 14, comprising two spaced closed slots extending from one web into the other web.

16. A protector for the corner of an article, the article at the corner having two substantially plane faces and two adjacent edge faces providing a corner edge, the protector having two spaced members to engage over respective ones of the plane faces, the protector having two side wall members connecting the two spaced members for overlying respective ones of the edge faces, the spaced members and the side wall members defining a mouth to allow the protector to be applied to the corner, each side wall member comprising (a) confronting flanges extending respectively from sides of the spaced members, (b) a closed slot extending along at least one of the flanges, and (c) a non-extensible web connecting the flanges, the webs of the side wall members being united at a location for overlying the corner edge, each web extending outwardly from the location to a position intermediate the ends of the closed slot in the respective said one flange; and a slot in each web nearer said one flange of the respective side wall member than the other flange and extending from the location outwardly to a closed end.

17. A protector as claimed in claim 16, in which the said one flange of the respective side wall members extends from the same spaced member and the slots in the webs form a single slot.

18. A protector as claimed in claim 17, in which each flange has a said closed slot therealong and there are two said single slots spaced between the flanges.

19. A protector as claimed in claim 1, wherein each said substantially non-extensible web is connected to a said one flange intermediate the ends of the said second slot formed in the said one flange, and each said second slot is completely enclosed on all sides by material of the said one flange along which it extends, each pair of confronting flanges being interconnected only by a said substantially non-extensible web whereby separation or approach movement of said spaced members is permitted by flexing of material of a said one flange in the area of its second slot adjacent the area of connection of said substantially non-extensible web.

* * * * *